United States Patent [19]

Reischauer

[11] 4,236,560

[45] Dec. 2, 1980

[54] FRAME FOR A CASE, WALLET OR SIMILAR DEVICE

[75] Inventor: Axel Reischauer, Kirschweiler, Fed. Rep. of Germany

[73] Assignee: Gold- und Silber- Scheideanstalt Oberstein Franz Reischauer, Idar-Oberstein, Fed. Rep. of Germany

[21] Appl. No.: 8,473

[22] Filed: Feb. 2, 1979

[30] Foreign Application Priority Data

Feb. 10, 1978 [DE] Fed. Rep. of Germany ..... 2805564

[51] Int. Cl.[3] ..... A45C 1/00

[52] U.S. Cl. ..... 150/46; 206/37

[58] Field of Search ..... 150/28 R, 38, 46; 206/37

[56] References Cited

U.S. PATENT DOCUMENTS

| | | | |
|---|---|---|---|
| 2,218,665 | 10/1940 | Tamoschat | 150/46 |
| 2,232,504 | 2/1941 | Zell | 150/46 UX |
| 2,527,339 | 10/1950 | Tamoschat | 150/46 |
| 2,536,785 | 1/1951 | Tamoschat | 150/46 |

FOREIGN PATENT DOCUMENTS 2537843 2/1976 Fed. Rep. of Germany .

*Primary Examiner*—Donald F. Norton

*Attorney, Agent, or Firm*—W. G. Fasse; D. F. Gould

[57] ABSTRACT

A case or wallet has a lid and a frame forming the casing proper provided with a covering held in position in the frame by a double clamping action between the frame and an insert which in turn is held in position by tongues or lugs bent out of a leg of the frame against the insert so that a clamping action along the edge of the covering is accomplished along two lines extending substantially in parallel to each other around the entire edge of the covering.

3 Claims, 2 Drawing Figures

FRAME FOR A CASE, WALLET OR SIMILAR DEVICE

BACKGROUND OF THE INVENTION

This invention relates to a frame for a case, wallet, or similar device having two parts, linked together by a hinge, each part including a main member and an insert, whereby the combination of the main member and the insert forms a groove extending around an outer rim for accepting an outer cover, and for holding an inner lining if so desired. The main member has, at its inner edge, a leg bent under a more or less right angle to its plane, this leg being provided with elements for holding the insert.

A frame of this type is provided with indentations on the bent leg of the main member for clamping the inner rim of the insert. However, this approach proves to be unsatisfactory from a practical point of view since it requires a close tolerance between the bent leg of the main part and the inner rim of the insert thus making the assembly of the frame in a case or wallet very difficult. In addition a case or wallet filled to its full capacity, will exert a considerable stress on the outer rim of the insert thus causing the danger that the pulled-over edge of the cover, held in the groove around the circumference might pull out the insert of its locked-in position thus separating it from the frame.

OBJECT OF THE INVENTION

It is the aim of this invention to avoid the foregoing by modifying a frame of this type so as to create an improved connection between the main member and the insert.

SUMMARY OF THE INVENTION

According to this invention this aim is being achieved by providing that the inner rim of the insert contacts the bent leg or part of the main member with some tolerance, and providing the main member with elements connecting the insert to the main member in a form locking and permanent manner.

These features of the invention do not only eliminate the draw-back mentioned above, they also have the additional effect that the insert is pressed against the outer rim of the main member with an increased spring force, thus holding the cover firmly, in an improved way, in its proper position.

According to a further feature of the invention the insert is essentially flat and provided with an additional groove for reinforcing the insert. This feature, besides permitting a quite simple manufacture of the insert, has the advantage of substantially increasing the elastic spring force mentioned above. Furthermore, this groove may serve as a receptacle for excessive adhesive which may be used for connecting the cover to the insert.

A further improvement of the invention provides tongues arranged along the rim of the bent leg of the main member which, after being bent over, hold the inner edge of the insert solidly and permanently in its intended position. This feature is simpler from a manufacturing point of view than the process of assembling the known frames for such hinged cases, or wallets.

BRIEF FIGURE DESCRIPTION

In the following, the invention will be discussed in further detail, with reference to the attached drawings.

Figure 1:
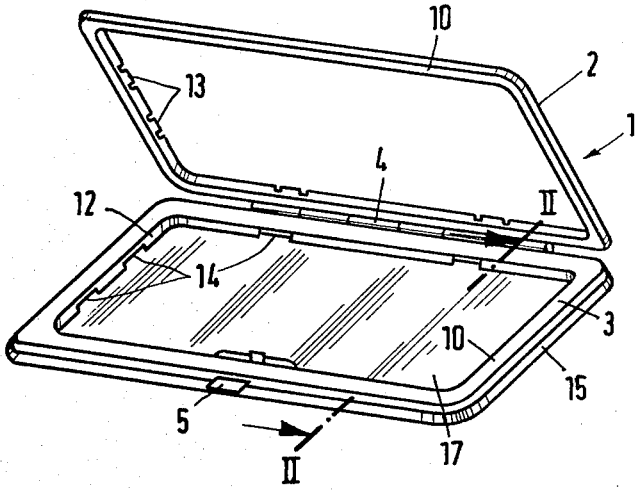
FIG. 1 shows a hinged case, with a frame according to the invention.

DETAILED DESCRIPTION OF A PREFERRED EXAMPLE EMBODIMENT AND OF THE BEST MODE OF THE INVENTION

The frame 1 of the case according to the invention, comprises two frame halves 2 and 3, connected by means of hinge members 4. The case may be opened, or kept in the closed position, by means of a releasable locking device 5.

Each half includes a main frame member 10 forming the faces of the finished product and which carries the two hinge members 4, and an insert 11.

The main frame member 10 of the frame comprises along its inner edge an inner rim 12 extending at a more or less right angle to the plane of the frame. The free edge of this rim or leg is provided with a number of pre-punched tongues 13.

The insert 11 is provided with a groove 18 running around its circumference for increasing the strength of the insert.

A case as shown in FIG. 1 will be assembled as follows. A padding layer 16 and a lining 17 are placed on the outer cover 15. The insert 11 is placed on top, and the protruding edge of the outer cover 15 is pulled over the insert and attached to the insert 11 by means of an adhesive. Excessive adhesive may be taken up by the groove 18.

Thereafter, the main frame member 10 is placed on top of the assembly in such a way, that the circumferential rim 12 reaches around the inner edge of the insert 11. To facilitate this procedure some play between the inner rim 12 and the inner edge of the insert 11 may be provided.

Figure 2:
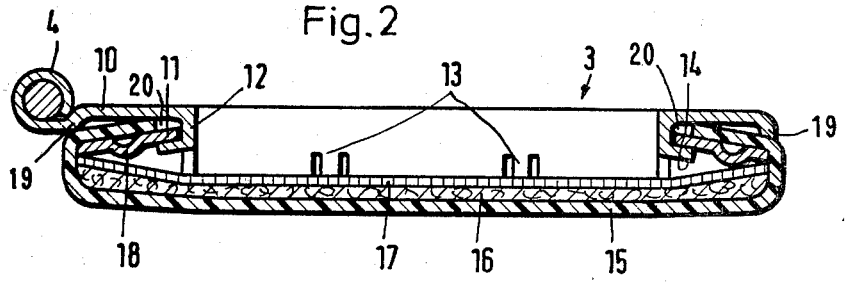
FIG. 2 shows a sectional view of the case of FIG. 1, along the line II—II.

In the following step the tongues 13 will be bent inwardly into position 14 whereby the shape shown in FIG. 2 results. These tongues 13 are dimensioned so as to withstand any stress which could bend back the tongues into their initial position out of the position 14. Thus the insert 11 is now firmly connected to the main member of the frame. Simultaneously, these tongues, in their final position 14, provide a strong, elastic force effective on the pulled-over edge of the outer cover 15 keeping it firmly secured between the insert 11 and the outer rim 19 of the main frame member 10. Simultaneously the insert 11 pinches the inner edge 20 of the cover 15 against the inwardly facing surface of the main frame member 10 as best seen in FIG. 2.

Details of the frame according to this invention may be modified depending on the intended use of such case.

I claim:

1. A frame for a case, wallet or similar device, comprising a main frame member (10) including a main leg, a radially outer rim (19) extending away from said main leg substantially at a right angle relative to said main leg, a radially inner rim (12) also extending away from said main leg substantially at a right angle and in the same direction as said radially outer rim, said radially inner rim (12) being longer than said radially outer rim (19), securing means (14) in said radially inner rim arranged to be bent radially outwardly, substantially flat insert means (11) fitting around said radially inner rim (12) and having a reinforcing groove (18) therein, cover means having an edge wrapped to substantially overlay one surface of said flat insert means, said one surface facing toward said main leg and toward said radially outer rim of said main frame member, said securing means (14) being so dimensioned that when said securing means are bent radially outwardly against said insert means, said insert means pinch said edge of said cover means against said main leg and against said radially outer rim thereby pinching the edge of the cover means along two parallel lines running all around said cover edge.

2. The frame of claim 1, wherein said securing means comprise a plurality of tongues (14) distributed along said radially inner leg (12) of said main frame member.

3. The frame of claims 1 or 2, wherein said reinforcing groove (18) of the insert means (11) faces with its open side toward said cover edge whereby excessive adhesive may be taken up by said groove.

* * * * *